US006434759B1

(12) United States Patent
Pondelick et al.

(10) Patent No.: US 6,434,759 B1
(45) Date of Patent: Aug. 20, 2002

(54) AUTOMATICALLY OPERABLE LID FOR A VACUUM WASTE RECEPTACLE

(75) Inventors: Mark A. Pondelick, Roscoe; Michael B. Hancock, Rockford, both of IL (US)

(73) Assignee: Evac International Oy, Helinski (FI)

( * ) Notice: Subject to any disclaimer, the term of this patent is extended or adjusted under 35 U.S.C. 154(b) by 0 days.

(21) Appl. No.: 09/897,541

(22) Filed: Jul. 2, 2001

(51) Int. Cl.[7] ..... A47K 13/10
(52) U.S. Cl. ..... 4/246.2; 4/431
(58) Field of Search ..... 4/246.1, 246.2, 4/431–433

(56) References Cited

U.S. PATENT DOCUMENTS

| | | | | | |
|---|---|---|---|---|---|
| 1,650,370 | A | * | 11/1927 | Mahoney | 4/433 |
| 1,822,319 | A | * | 9/1931 | Schwartz | 4/432 |
| 2,119,328 | A | * | 5/1938 | Haberlin | 4/432 |
| 4,063,315 | A | * | 12/1977 | Carolan et al. | 4/316 |
| 4,275,470 | A | | 6/1981 | Badger et al. | 4/316 |
| 4,291,422 | A | | 9/1981 | Shoemaker et al. | 4/251 |
| 4,357,719 | A | | 11/1982 | Badger et al. | 4/316 |
| 4,376,314 | A | * | 3/1983 | Iwans | 4/431 |
| 5,222,260 | A | | 6/1993 | Piper | 4/246 |
| 5,245,711 | A | * | 9/1993 | Oldfelt et al. | 4/431 X |
| 5,400,442 | A | | 3/1995 | Pendlebury | 4/246.2 |
| 5,604,936 | A | | 2/1997 | Mausolf | 4/246.1 |

FOREIGN PATENT DOCUMENTS

| | | | | |
|---|---|---|---|---|
| JP | 4161124 | * | 6/1992 | 4/246.2 |
| JP | 6105756 | * | 4/1994 | 4/246.1 |
| WO | 90/06715 | * | 6/1990 | 4/246.2 |

* cited by examiner

*Primary Examiner*—Charles E. Phillips
(74) *Attorney, Agent, or Firm*—Marshall Gerstein Borun

(57) ABSTRACT

A vacuum toilet for use with a waste pipe maintained under partial vacuum pressure. The vacuum toilet comprises a bowl having an upper surface defining an opening and a lid supported for pivotable movement between a lowered position, in which the lid covers the opening, and a raised position, in which the lid is rotated away from the opening. An actuator has a rod connected to the lid, the rod being movable between a first position, in which the lid is placed in the raised position, and a second position, in which the lid is placed in the lowered position. A controller is operatively connected to the actuator, wherein the controller normally operates the actuator with the rod in the first position. The controller automatically operates the actuator rod to the second position during a toilet flush cycle, and subsequently returns the actuator rod back to the first position after the toilet flush cycle.

20 Claims, 2 Drawing Sheets

AUTOMATICALLY OPERABLE LID FOR A VACUUM WASTE RECEPTACLE

FIELD OF THE INVENTION

The present invention generally relates to vacuum waste systems and, more particularly, to a receptacle in a vacuum waste system having an automatically operable lid.

BACKGROUND OF THE INVENTION

Vacuum waste systems are generally known in the art. Such systems typically comprise one or more waste receptacle, such as a toilet, in fluid communication with a waste tank. The waste tank is maintained at a pressure that is lower than that surrounding the toilet by a vacuum source, such as a vacuum pump or blower. In addition, when the vacuum waste system is provided on an aircraft, the lower tank pressure may be supplied by high altitude (i.e., above approximately 16,000 feet) atmospheric air. A flush valve, which opens in response to a flush command, is disposed between each toilet and the waste tank to control fluid communication between the toilet and the waste tank. The vacuum waste system may also include a spray ring for rinsing the toilet. The spray ring is connected by a rinse line to a source of rinse fluid. A rinse valve is disposed in the rinse line to control discharge of rinse fluid from the spray ring.

In operation, the rinse and flush valves are actuated in response to a flush command. The rinse valve is typically opened first to discharge rinse fluid from the spray ring, thereby to rinse the toilet. The flush valve is subsequently opened to establish fluid communication between the tank and the toilet outlet. The resulting pressure differential between the tank and the toilet forces waste material from the toilet to the tank. After a predetermined period has elapsed, the flush valve closes and the toilet is available for subsequent use.

While the flush valve is open, it will be appreciated that air from the toilet room is pulled into the vacuum waste system as long as a pressure differential exists. The incoming air may travel at a velocity sufficient to create noise that is audible outside of the toilet room. Such noise may be bothersome, particularly when the toilet room is located in close proximity to other people and is frequently used, such as on an aircraft.

Vacuum toilets are often provided with a lid that is movable between a generally vertical raised position and a generally horizontal lowered position. The lid, when placed in the lowered position, may significantly reduce the level of noise heard during a flush. A seal may be attached to the lid for closely conforming to the seat or toilet base, thereby to further reduce the noise level. For various reasons, however, the lid is rarely lowered before flushing. Some users are unaware or simply do not think to close the lid, while others find it inconvenient or unsanitary. Regardless of the reason, the lid is often left in the raised position during a flush cycle, thereby subjecting the area in the vicinity of the toilet to the maximum noise level.

SUMMARY OF THE INVENTION

In accordance with certain aspects of the present invention, a vacuum waste system adapted for use with a waste pipe maintained under partial vacuum pressure is provided. The vacuum waste system comprises a receptacle for receiving waste, the receptacle having an outlet in fluid communication with the waste pipe and an upper surface defining an opening. A flush valve is disposed in the waste pipe, the flush valve being normally closed but movable to an open position for a predetermined valve open period during a flush cycle. A lid is provided that is movable between a raised position, in which the lid is spaced from the opening defined by the upper surface, and a lowered position, in which the lid covers the opening. An actuator is operatively connected to the lid for holding the lid in the raised position, the actuator automatically driving the lid during the flush cycle to the lowered position before the flush valve is in the open position and returning the lid to the raised position after the predetermined valve open period, when the flush valve has returned to the closed position.

In accordance with additional aspects of the present invention, a vacuum toilet is provided for use with a waste pipe maintained under partial vacuum pressure. The vacuum toilet comprises a bowl having an upper surface defining an opening and a lid supported for pivotable movement between a lowered position, in which the lid covers the opening, and a raised position, in which the lid is rotated away from the opening. An actuator has a rod connected to the lid, the rod being movable between a first position, in which the lid is placed in the raised position, and a second position, in which the lid is placed in the lowered position. A controller is operatively connected to the actuator, wherein the controller normally operates the actuator with the rod in the first position, the controller automatically operating the actuator rod to the second position during a toilet flush cycle, and the controller automatically operating the actuator rod back to the first position after the toilet flush cycle.

In accordance with further aspects of the present invention, apparatus is provided for actuating a lid attached to a vacuum waste receptacle. The receptacle has an upper surface defining an opening, and the lid is movable between a lowered position, in which the lid covers the opening, and a raised position, in which the lid is spaced from the opening. The vacuum waste receptacle is adapted for selective communication with a waste pipe maintained under partial vacuum pressure. The apparatus comprises a pneumatic actuator having a cylinder and a rod operatively connected to the lid. The rod is movable between a first position, in which the lid is placed in the raised position, and a second position, in which the lid is placed in the lowered position. The cylinder is in fluid communication with the waste pipe for driving the rod between the first and second positions. A controller is operatively connected to the pneumatic actuator, wherein the controller normally operates the pneumatic actuator with the rod in the first position, automatically operates the actuator rod to the second position during a toilet flush cycle, and automatically operates the actuator rod back to the first position after the toilet flush cycle.

DETAILED DESCRIPTION OF THE PREFERRED EMBODIMENT

Figure 1:
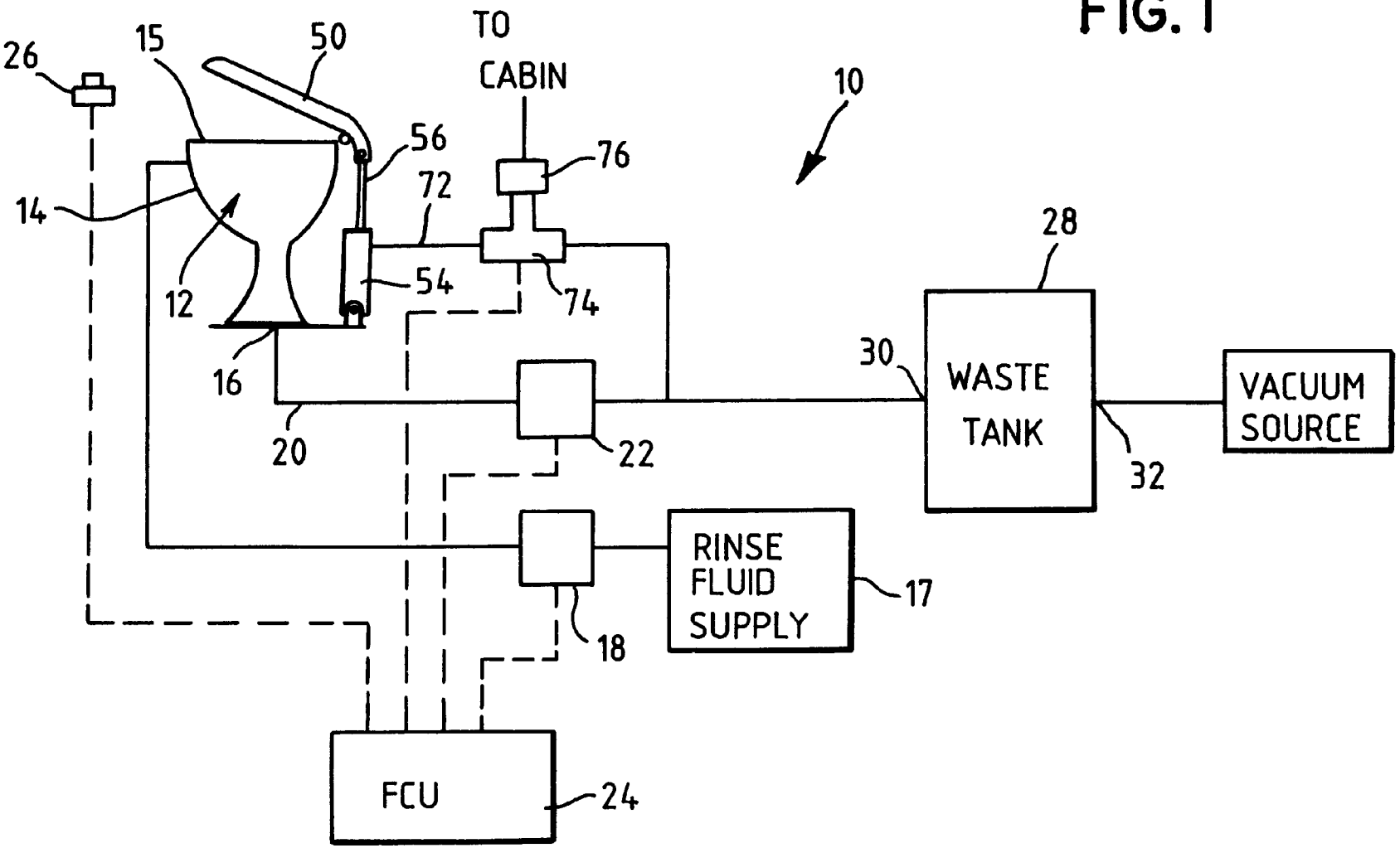
FIG. 1 is a schematic illustration of a vacuum waste system having a toilet with automatically closing lid, in accordance with the teachings of the present invention.

A vacuum waste system is generally indicated in FIG. 1 by the reference numeral 10. While the vacuum waste system 10 is described herein in conjunction with an aircraft installation, those skilled in the art will appreciate that the vacuum waste system 10 is not limited to this particular environment of use. On the contrary, the teachings of the present invention may be applied to a vacuum waste system installed in any type of mobile (i.e., aircraft, train, ship) or stationary (i.e., home, office) installation.

Figure 2:
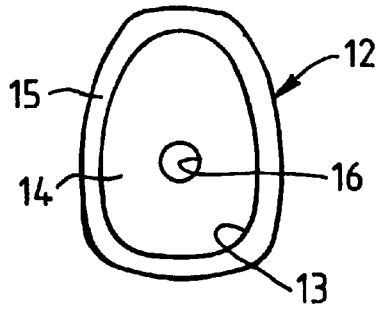
FIG. 2 is a plan view of a toilet used in the vacuum waste system of FIG. 1.

As shown in FIG. 1, the vacuum waste system includes a waste receptacle, such as a toilet 12, for receiving waste positioned in a toilet room. The toilet 12 has a bowl 14 and an outlet 16 and an upper surface 15 defining an opening 13 (FIG. 2). A seat (not shown) may be pivotably attached to the toilet upper surface 15. The toilet 12 may include a spray ring (not shown) disposed inside the bowl 14 that is connected to a source of rinse fluid 17 through a rinse valve 18. A waste pipe 20 is connected to the outlet 16 of the toilet 12 and has a flush valve 22 disposed therein. Operation of the flush valve 22 and rinse valve 18 is controlled by a flush control unit (FCU) 24, the construction and operation of which is well known in the field. A flush button 26 is connected to the flush control unit 24 for generating a flush command, in response to which the FCU 24 operates the rinse valve 18 and flush valve 22 as described in greater detail below.

In the preferred embodiment, the rinse valve 18, flush valve 22, and FCU 24 are electrically operated, however it will be appreciated that they may be operated by pneumatic or other actuating means. While the illustrated embodiment shows a single toilet 12, it will be appreciated that the vacuum waste system 10 may incorporate a plurality of toilets.

A waste tank 28 is provided for collecting waste transported from the toilet 12. The waste tank 28 has a waste inlet port 30 connected to the waste pipe 20 thereby to establish fluid communication between the toilet 12 and the waste tank 28. The waste tank 28 also has a vacuum port 32 connected to a vacuum source for generating vacuum in the waste tank 28.

As is well known in the art, alternative vacuum sources may be provided for aircraft installations. When the aircraft is on the ground or at low altitudes, defined herein as below approximately 16,000 feet, a vacuum generator such as a vacuum pump or ejector is provided as the vacuum source. When the aircraft is at high altitudes (i.e., above 16,000 feet), the atmospheric air outside the aircraft is sufficiently lower than the pressurized cabin to provide the necessary air pressure differential, and therefore it is used as the "vacuum source."

In operation, a flush cycle may be initiated by depressing the flush button 26, which generates a flush command. In response to the flush command, the FCU 24 temporarily opens the rinse valve 18 to discharge rinse fluid to the toilet 12. The FCU 24 also opens the flush valve 22 for a predetermined valve open period to communicate the relatively lower pressure inside the tank 28 to the toilet outlet 16. The air surrounding the toilet 12 is at a relatively higher pressure, resulting in a pressure differential across the waste material in the toilet 12. The force created by the pressure differential transports the waste material from the toilet 12 to the tank 28. In addition, air from outside the toilet 12 is pulled into the tank 28 through the toilet 12.

Figure 3:
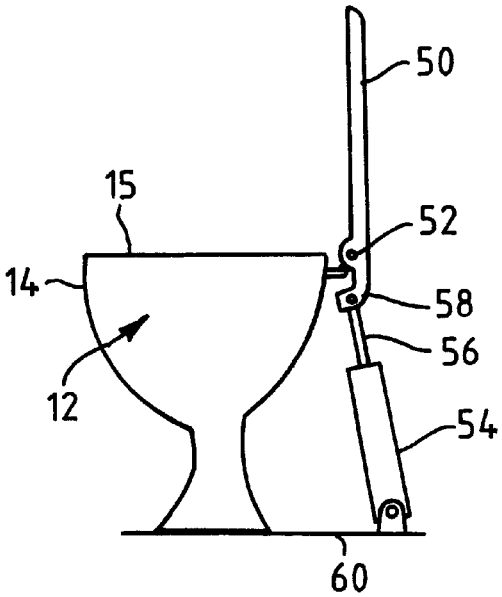
FIG. 3 is a partially schematic side elevation view of a toilet with the lid in a raised position.
Figure 4:
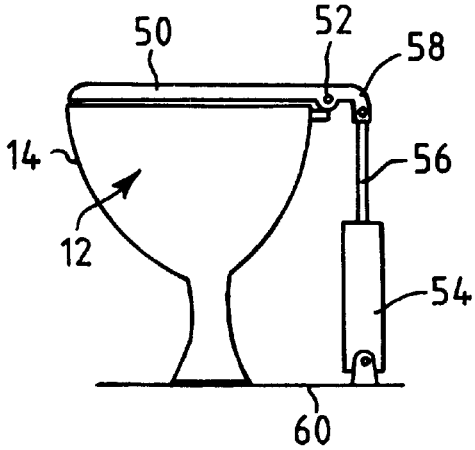
FIG. 4 is a partially schematic side elevation view of a toilet with the lid in a lowered position.

A lid 50 is provided for covering the opening 13 of the toilet bowl 14. As best shown in FIGS. 3 and 4, the lid 50 is attached to the toilet 12 by a hinge 52. The hinge allows the lid 50 to rotate between a generally vertical raised position, as shown in FIG. 3, and a generally horizontal lowered position, as shown in FIG. 4. In the lowered position, the lid 50 overlies and covers the opening 13 of the toilet bowl upper surface 15, thereby to contain noise generated during a flush cycle. Furthermore, the lid 50 may be shaped to accommodate a toilet seat (not shown) disposed on top of the toilet bowl 14. Still further, the lid 50 may include a seal (not shown) that closely conforms to the seat and/or toilet bowl 14.

An actuator is provided for automatically closing the lid 50 before the flush valve 22 is opened. In the illustrated embodiment, the actuator is provided in the form of a pneumatic cylinder 54. A rod 56 of the cylinder is pivotably attached to a lever 58 projecting from a rear of the lid 50. A base of the cylinder 54 is pivotably attached to a frame 60 supporting the toilet 12. The cylinder rod 56 is movable between retracted and extended positions, as shown in FIGS. 3 and 4, respectively. As the rod 56 moves between the two positions, the cylinder 54 may slightly rotate. The pivotable connections between the cylinder base/toilet frame and rod/lever allow for any such rotation.

Figure 5:
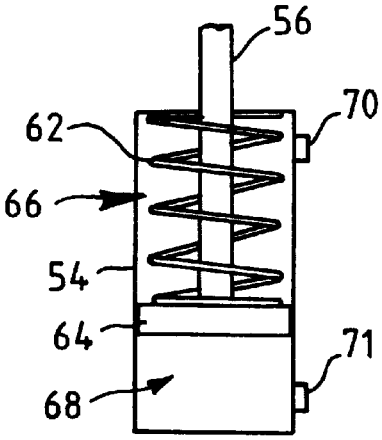
FIG. 5 is a partially schematic cross-sectional view of a pneumatic cylinder for actuating the lid, the pneumatic cylinder being in a retracted position.
Figure 6:
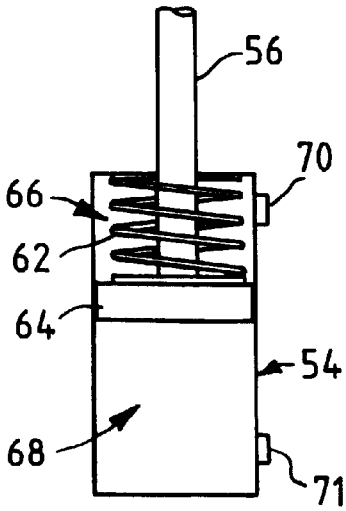
FIG. 6 is a partially schematic cross-sectional view of the pneumatic cylinder of FIG. 5 in an extended position.

The pneumatic cylinder 54 is preferably provided with a spring 62 for biasing the rod 56 in the retracted position. As best shown in FIGS. 5 and 6, the cylinder 54 includes a piston 64 attached to the rod 56. The piston 64 divides the cylinder 54 into an upper chamber 66 and a lower chamber 68. In the illustrated embodiment, the spring 62 is disposed in the upper chamber 66 to bias the piston 64 downward. The downward piston bias urges the rod 56 toward the retracted position, which, in turn, drives the lid 50 to the raised position.

The rod 56 of the pneumatic cylinder 54 may be driven to the extended position using the partial vacuum pressure of the vacuum toilet system 10. As shown in FIGS. 5 and 6, a port 70 is provided in the upper chamber 66. The port 70 is connected to a vacuum line 72 (FIG. 1), which communicates with the waste pipe 20. A solenoid valve 74 is disposed in the vacuum line 72 for controlling fluid communication between the waste pipe 20 and port 70. In the illustrated embodiment, the solenoid valve 74 is a three way valve having a vent position, in which the port 70 communicates with the toilet room, and a supply position, in which the port 70 communicates with the waste pipe 20.

A second port 71 is provided for the lower chamber 68 which vents to the toilet room. The second port 71 allows air to enter or exit the lower chamber 68 as the piston 64 moves.

When the solenoid valve 74 is in the vent position, so that toilet room air is communicated to the port 70, the pressure between the upper and lower chambers 66, 68 is substantially balanced so that the spring 62 drives the piston 64 downward, thereby retracting the rod 56 (FIG. 5). When partial vacuum is present in waste pipe 20 and the solenoid valve 74 is in the supply position, the partial vacuum communicated to the port reduces the pressure in the cylinder upper chamber 66 to overcome the force of the spring 62. As a result, the piston 64 is drawn upwardly, thereby driving the rod 56 toward the extended position, as illustrated in FIG. 6. The solenoid valve 74 preferably includes a regulator 76 (FIG. 1) for controlling the flow of toilet room air into the upper chamber 66 to prevent the lid 50 from opening too quickly.

The solenoid valve 74 is preferably controlled by the FCU 24 to automatically lower the lid 50 during a flush cycle. The solenoid valve 74 is normally in the vent position, so that toilet room air pressure is present in the cylinder upper chamber 66. As a result, the cylinder rod 56 is retracted and the lid 50 is in the raised position (FIG. 3). In response to a flush command, and preferably before the flush valve 22 opens, the FCU 24 operates the solenoid valve 74 to the supply position, so that the sewer pipe 20 communicates with the cylinder port 70. Consequently, the piston 64 drives the rod 56 to the extended position, thereby moving the lid 50 to the lowered position (FIG. 4). The danger of injury from pinching a user between the closing lid 50 and the toilet bowl 14 is low, since the partial vacuum pressure generated in the system 10, and therefore the closing force exerted on the lid 50, is relatively low.

Once the flush valve 22 returns to the closed position after the predetermined valve open period, the FCU 24 operates the solenoid valve back to the vent position, so that the cylinder port 70 communicates with the toilet room. As the toilet room air enters and raises the pressure in the upper chamber 66, the spring 62 again drives the piston 64 downward, thereby moving the rod 56 to the retracted position and the lid 50 to the raised position.

If a user sits back down on the lid 50 before it is raised, the weight of the user will counteract the spring 62 and the lid 50 will remain in the lowered position. In this instance, the resiliency of the spring 62 absorbs the weight of the user and allows the rod 56 to remain in the extended position without placing undue stress on the actuator components. When the user subsequently stands, the spring 62 will automatically raise the lid 50 in a controlled manner. Because the lid 50 is automatically closed during the flush cycle, the amount of noise detected in the vicinity of the toilet 12 is reduced.

The foregoing detailed description has been given for clearness of understanding only, and no unnecessary limitations should be understood therefrom, as modifications would be obvious to those skilled in the art.

What is claimed is:

1. A vacuum waste system adapted for use with a waste pipe maintained under partial vacuum pressure, the vacuum waste system comprising:

a receptacle for receiving waste, the receptacle having an outlet in fluid communication with the waste pipe and an upper surface defining an opening;

a flush valve disposed in the waste pipe, the flush valve being normally closed but movable to an open position for a predetermined valve open period during a flush cycle;

a lid movable between a raised position, in which the lid is spaced from the opening defined by the upper surface, and a lowered position, in which the lid covers the opening; and an actuator operatively connected to the lid for holding the lid in the raised position, the actuator automatically driving the lid during the flush cycle to the lowered position before the flush valve is in the open position and returning the lid to the raised position after the predetermined valve open period, when the flush valve has returned to the closed position.

2. The vacuum toilet of claim 1, in which the actuator uses the partial vacuum pressure in the waste pipe to drive the lid from the raised position to the lowered position.

3. The vacuum toilet of claim 1, in which the actuator comprises a pneumatic cylinder.

4. The vacuum toilet of claim 3, in which the pneumatic cylinder includes a supply port and a vacuum line extends between the supply port and the waste pipe.

5. The vacuum toilet of claim 4, further comprising a solenoid valve disposed in the vacuum line for controlling fluid communication between the waste pipe and the supply port.

6. The vacuum toilet of claim 1, in which the actuator includes a spring for biasing the lid toward the raised position.

7. The vacuum toilet of claim 1, in which a lever projects from a rear portion of the lid and the actuator is pivotably connected to the lever.

8. A vacuum toilet for use with a waste pipe maintained under partial vacuum pressure, the vacuum toilet comprising:

a bowl having an upper surface defining an opening;

a lid supported for pivotable movement between a lowered position, in which the lid covers the opening, and a raised position, in which the lid is rotated away from the opening;

an actuator having a rod connected to the lid, the rod being movable between a first position, in which the lid is placed in the raised position, and a second position, in which the lid is placed in the lowered position; and a controller operatively connected to the actuator, wherein the controller normally operates the actuator with the rod in the first position, the controller automatically operating the actuator rod to the second position during a toilet flush cycle, and the controller automatically operating the actuator rod back to the first position after the toilet flush cycle.

9. The vacuum toilet of claim 8, in which the actuator uses the partial vacuum pressure in the waste pipe to drive the lid from the raised position to the lowered position.

10. The vacuum toilet of claim 8, in which the actuator comprises a pneumatic cylinder.

11. The vacuum toilet of claim 10, in which the pneumatic cylinder includes a supply port and a vacuum line extends between the supply port and the waste pipe.

12. The vacuum toilet of claim 11, further comprising a solenoid valve disposed in the vacuum line for controlling fluid communication between the waste pipe and the supply port.

13. The vacuum toilet of claim 12, in which the solenoid valve comprises a three-way valve having a supply position, in which the pneumatic cylinder is placed in fluid communication with the waste pipe, and a vent position, in which the pneumatic cylinder is placed in fluid communication with an area exterior of the toilet.

14. The vacuum toilet of claim 8, in which the actuator includes a spring for biasing the actuator rod toward the first position.

15. The vacuum toilet of claim 8, in which a lever projects from a rear portion of the lid and the actuator is pivotably connected to the lever.

16. Apparatus for actuating a lid attached to a vacuum waste receptacle having an upper surface defining an opening, the lid being movable between a lowered position, in which the lid covers the opening, and a raised position, in which the lid is spaced from the opening, wherein the vacuum waste receptacle is adapted for selective communication with a waste pipe maintained under partial vacuum pressure, the apparatus comprising:

a pneumatic actuator having a cylinder and a rod operatively connected to the lid, the rod being movable between a first position, in which the lid is placed in the raised position, and a second position, in which the lid is placed in the lowered position, the cylinder being in fluid communication with the waste pipe for driving the rod between the first and second positions; and a controller operatively connected to the pneumatic actuator, wherein the controller normally operates the pneumatic actuator with the rod in the first position, the controller automatically operating the actuator rod to the second position during a toilet flush cycle, and the controller automatically operating the actuator rod back to the first position after the toilet flush cycle.

17. The apparatus of claim 16, in which the cylinder includes a supply port and a vacuum line extends between the supply port and the waste pipe.

18. The apparatus of claim 17, further comprising a solenoid valve disposed in the vacuum line for controlling fluid communication between the waste pipe and the supply port.

19. The apparatus of claim 18, in which the solenoid valve comprises a three-way valve having a supply position, in which the pneumatic cylinder is placed in fluid communication with the waste pipe, and a vent position, in which the pneumatic cylinder is placed in fluid communication with an area exterior of the toilet.

20. The apparatus of claim 16, in which the pneumatic actuator includes a spring for biasing the actuator rod toward the first position.

* * * * *